US012808167B2

(12) United States Patent
Palmer

(10) Patent No.: US 12,808,167 B2
(45) Date of Patent: Nov. 24, 2026

(54) SANITATION SYSTEM

(71) Applicant: U.S. Titan Manufacturing, LLC, Fort Morgan, CO (US)

(72) Inventor: Coy Palmer, Fort Morgan, CO (US)

(73) Assignee: U.S. TITAN MANUFACTURING, LLC, Fort Morgan, CO (US)

( * ) Notice: Subject to any disclaimer, the term of this patent is extended or adjusted under 35 U.S.C. 154(b) by 87 days.

(21) Appl. No.: 18/930,800

(22) Filed: Oct. 29, 2024

(65) Prior Publication Data

US 2026/0117504 A1 Apr. 30, 2026

(51) Int. Cl.
*E03C 1/182* (2006.01)

(52) U.S. Cl.
CPC ..... *E03C 1/182* (2013.01)

(58) Field of Classification Search
CPC ..... E03C 1/182
See application file for complete search history.

(56) References Cited

U.S. PATENT DOCUMENTS

| | | | | |
|---|---|---|---|---|
| 2,830,618 | A | 4/1958 | Mitchell | |
| 3,535,715 | A | 10/1970 | Booker et al. | |
| 6,173,458 | B1 | 1/2001 | Maddux | |
| 8,297,291 | B1 * | 10/2012 | Bluestone | B08B 1/40 134/91 |
| 2008/0210260 | A1 * | 9/2008 | Porter | B08B 3/006 134/57 R |
| 2022/0178122 | A1 * | 6/2022 | Grybush | E03C 1/182 |
| 2023/0003009 | A1 * | 1/2023 | Peavy | A47K 1/02 |
| 2024/0426088 | A1 * | 12/2024 | L'Henaff | E03C 1/04 |
| 2025/0277357 | A1 * | 9/2025 | Detlaff | F25C 5/043 |

FOREIGN PATENT DOCUMENTS

| | | |
|---|---|---|
| CN | 211341021 U | 8/2020 |
| KR | 20-0163350 Y1 | 2/2000 |

OTHER PUBLICATIONS

PCT; International Search Report and Written Opinion dated Jan. 7, 2026 in PCT Application No. PCT/US2025/052715.

* cited by examiner

*Primary Examiner* — Christine J Skubinna
(74) *Attorney, Agent, or Firm* — Snell & Wilmer L.L.P.

(57) ABSTRACT

A sanitation system is provided. The sanitation system may have a sink with a bowl. The sanitation system may have a tool cleaner. The tool cleaner may have a tool cleaner reservoir to hold water for cleaning of tools and may have an upper drain channel that is a trough connecting the tool cleaner reservoir to the bowl. The channel may communication fluid between the tool cleaner reservoir and the bowl. The tool cleaner may have flowing fluid for cleaning of tools and a sink may also be provided for cleaning of items.

16 Claims, 7 Drawing Sheets

SANITATION SYSTEM

BACKGROUND

1. Field

The various aspects and embodiments described herein relate to sanitation systems and more specifically, to workstations for sanitary food processing for operators in industrial and agricultural settings.

2. Description of the Related Art

Operators in industrial and agricultural settings such as food processing facilities must process food or other consumable products efficiently, while maintaining hygienic standards and ameliorating cross-contamination risks as different products are processed. For instance, a workpiece, such as a meat carcass may require processing with knives or other tools. The worker has certain hygiene and food safety standards to maintain as the worker switches from workpiece to workpiece. For instance, a worker using tools to process an animal carcass for food has certain sanitary requirements related to tool washing between the processing of different animal carcasses.

In many instances, the workstation itself must be routinely cleaned to address these requirements. However, existing workstations may harbor contamination and/or bacteria. Moreover, existing workstations may hamper the efficiency of the worker by requiring a worker to stop the processing workflow and interact with the workstation periodically to adjust valves. These conventional workstations present both challenges in maintaining appropriate cleanliness of the workstation, challenges in ameliorating cross contamination among workpieces, and challenges in ease of use by an operator. Thus a need exists for a sanitation system according to the disclosure herein.

SUMMARY

A sanitation system may include a sink. The sanitation system may include a tool cleaner. The sink may have a bowl. The tool cleaner may have a tool cleaner reservoir to hold water for cleaning of tools. The tool cleaner may have an upper drain channel. The upper drain channel may be a trough connected between tool cleaner reservoir and the bowl and configured to communicate water between the tool cleaner reservoir and the bowl.

The sanitation system may have other features, too. The upper drain channel drains the water from the tool cleaner reservoir to enable a continuous filling of the water into the tool cleaner reservoir to wash tools therein. The sanitation system may have a spout to fill water into the tool cleaner reservoir of the tool cleaner. The sink may have a spout for releasing fluid into the bowl and a drain for removing the fluid from the bowl. The system may have a control interface. The control interface may have a plurality of control paddles mounted below the sink to operate one or more valve for the releasing the fluid into the bowl.

The trough of the upper drain channel may have sidewalls extending from the tool cleaner to the bowl. Each sidewall may have an uppermost edge coplanar with a surface of the work table. The trough of the upper drain channel may also include a floor coplanar with a tool holder of the tool cleaner. The trough skims floating matter from fluid in the tool cleaner reservoir.

The tool cleaner may have further features. For instance, the tool cleaner may have a tool holder with a selectively removable disk inserted into the tool cleaner reservoir and having slots to receive tools through the disk and into the tool cleaner reservoir. The tool holder orients tools partially in the tool cleaner reservoir for cleaning. The disk may have two cutouts, a first cutout to permit inflow of fluid past the disk into the tool cleaner reservoir and a second cutout to permit outflow of fluid from the tool cleaner reservoir into the upper drain channel. The disk may have a plurality of orientation tabs disposed at an edge of the disk to orient the disk within the tool cleaner reservoir relative to edges of the tool cleaner reservoir. The tool cleaner may also have concentric lip extending inwardly from a wall of the tool cleaner reservoir and providing a resting edge for the disk to rest on.

In various embodiments, the tool holder further includes an attachment device. The attachment device may be a rod having a widened flange. The rod may pass through the disk. The widened flange may be connectable to the disk. The rod is slidable relative to the tool cleaner reservoir to enable the disk to be selectably lifted out of, and inserted into the tool cleaner reservoir for cleaning and use, respectively.

The system may have a work table. The work table may have a surface continuous with an upper edge of the sink and the tool cleaner. The work table may also have a splash wall extending perpendicularly from the surface of the work table in a single continuous piece of material continuous with the surface. The splash wall supports a solution dispenser at a distance from the surface.

Elaborating on the solution dispenser, this feature may include a dispenser reservoir attached to a mount. The mount is attached to the splash wall. The dispenser reservoir is rotationally attached to the mount for rotation about a rotational axis. The mount is biased off-center relative to the dispenser reservoir so that the dispenser reservoir is self-righting. The solution dispenser has a spout for pouring a solution from the dispenser in response to the rotation. The dispenser reservoir is self-righting so that the dispenser resists pouring of the solution from the dispenser. The dispenser reservoir may have a handle extending from the dispenser reservoir at a location between the rotational axis coinciding to the rotational attachment of the dispenser reservoir to the mount, and a lower side of the dispenser reservoir nearest the surface. The dispenser reservoir may have a spout extending from an upper side of the dispenser reservoir farthest from the surface. The rotational axis is at a location between the location of the handle and a location of the spout. The dispenser reservoir may include a vent defined through the upper side of the dispenser reservoir farthest from the surface.

In various examples, a further embodiment of the sanitation system is provided. The system may include a sink. The sink may have a bowl. The system may have a work table. The work table may have a surface continuous with an upper edge of the sink. The work table may have a splash wall extending perpendicularly from the surface of the work table in a single continuous piece of material continuous with the surface. The system may include a solution dispenser. The solution dispenser may be supported by the splash wall at a distance from the surface. The solution dispenser may have a dispenser reservoir attached to a mount. The mount is attached to the splash wall and the dispenser reservoir is rotationally attached to the mount for rotation about a rotational axis. The mount may be biased off-center relative to the dispenser reservoir so that the dispenser reservoir is self-righting. The solution dispenser may have a spout for pouring a solution from the dispenser in response to the rotation. The dispenser reservoir is self-righting so that the dispenser resists pouring of the solution from the dispenser.

One or more further features are provided. For instance, the dispenser reservoir may have a handle extending from the dispenser reservoir at a location between the rotational axis coinciding to the rotational attachment of the dispenser reservoir to the mount, and a lower side of the dispenser reservoir nearest the surface. The dispenser reservoir may have a spout extending from an upper side of the dispenser reservoir farthest from the surface. The rotational axis is at a location between the location of the handle and a location of the spout. The dispenser reservoir may include a vent defined through the upper side of the dispenser reservoir farthest from the surface.

The system may have a tool cleaner. The tool cleaner may include a tool cleaner reservoir to hold water for cleaning of tools. The tool cleaner may include an upper drain channel. The upper drain channel may be a trough connected between tool cleaner reservoir and the bowl and configured to drain water from the tool cleaner into the bowl. The upper drain channel may have sidewalls and a floor. The sidewalls may extend from the tool cleaner to the bowl. Each sidewall may have an uppermost edge coplanar with a surface of the work table. The floor may extend between the sidewalls and the tool cleaner and the bowl. The upper drain channel may form a trough that skims floating matter from fluid in the tool cleaner reservoir.

Yet further embodiments are contemplated. For instance, a sanitation system may be provided. The system may include a tool cleaner. The tool cleaner may have a tool cleaner reservoir to hold water for cleaning of tools. The tool cleaner may have an upper drain channel that is a trough connected between tool cleaner reservoir and a drain and that is configured to communicate water between the tool cleaner reservoir and the drain. The tool cleaner may have a tool holder. The tool holder may be a selectively removable disk inserted into the tool cleaner reservoir and having slots to receive tools through the disk and into the tool cleaner reservoir. The tool holder may orient tools partially in the tool cleaner reservoir for cleaning. The system may have a sink. The sink may have a bowl with the drain. The upper drain channel may be connected to the bowl to provide fluid passage from the trough to the drain. The system may have a work table having a surface. The surface may be continuous with an upper edge of the bowl. The surface may be continuous with an upper edge of the tool cleaner reservoir. The surface may have a splash wall extending perpendicularly from the surface of the work table in a single continuous piece of material continuous with the surface to support a solution dispenser at a distance from the surface.

BRIEF DESCRIPTION OF THE DRAWINGS

Other apparatus, methods, features, and advantages of the present disclosure will be apparent to one skilled in the art upon examination of the following figures and detailed description. Component parts shown in the drawings are not necessarily to scale and may be exaggerated to better illustrate the important features of the present disclosure.

DETAILED DESCRIPTION

Operators in industrial and agricultural settings often must utilize tools that require cleaning between tasks and with items, workpieces, or materials that require frequent washing of the operator's hands or of other items. For instance, in a food processing environment, an operator may desire to (or be required to) wash tools, hands, or other items at intervals to prevent cross-contamination. For instance, in a meat processing plant, an operator may use knives to process animal carcasses to harvest different types, pieces, and cuts of meat from the carcass. The operator may wash tools such as knives periodically, or between carcasses. The operator may wash his or her hands periodically, or between carcasses. Other washing tasks are also contemplated. In various instances, other food preparation or different tasks occur. In many of these instances, food safety or sanitization requirements are important and extensive. Thus, a need exists for a sanitation system that accommodates different and varied sanitation tasks without introducing discomfort, causing fatigue, or otherwise discouraging or hampering appropriate adherence to desired procedures by the operators.

Figure 1A:
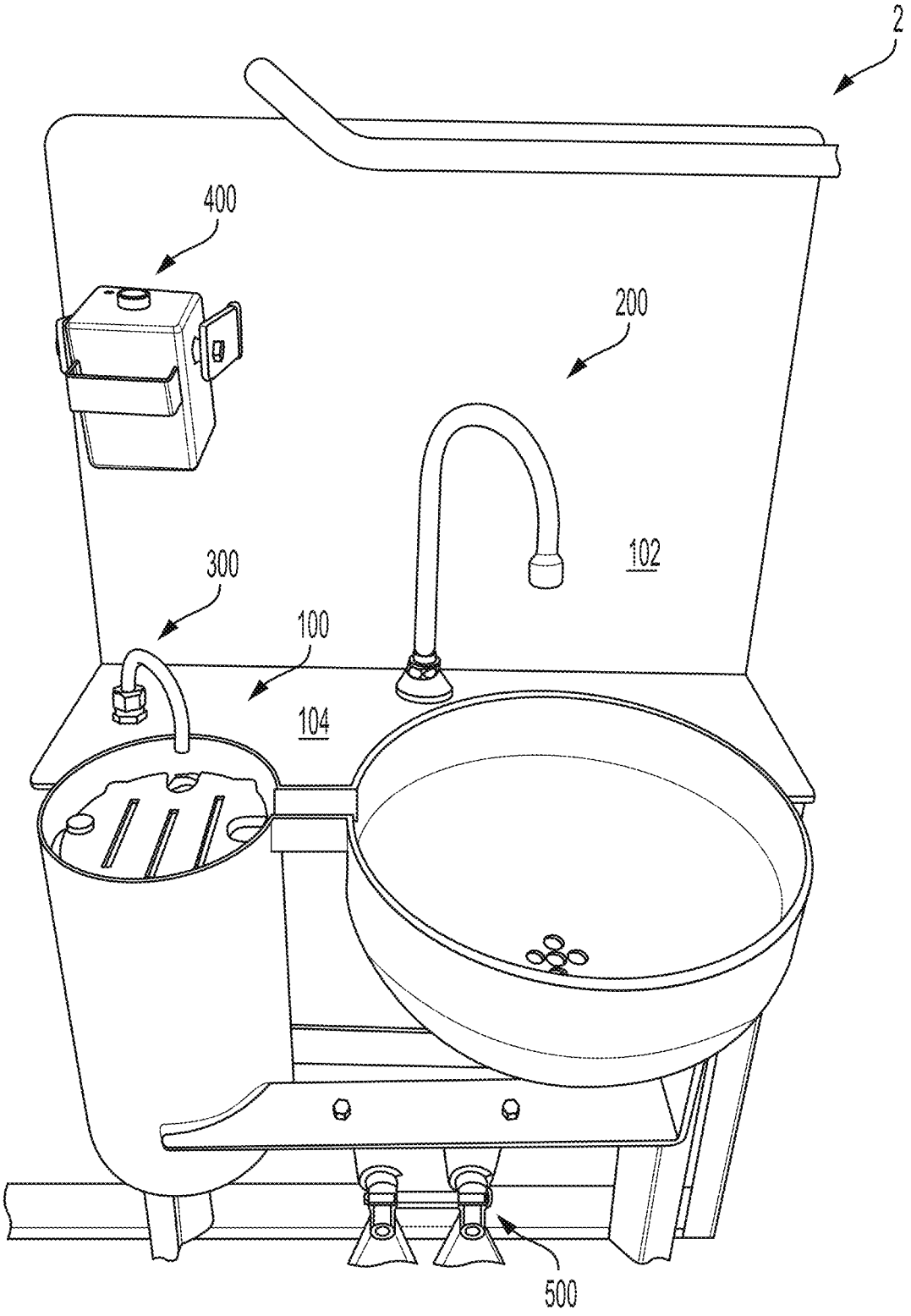
FIGS. 1A-1B illustrate views of a sanitation system, in accordance with various embodiments.
Figure 1B:
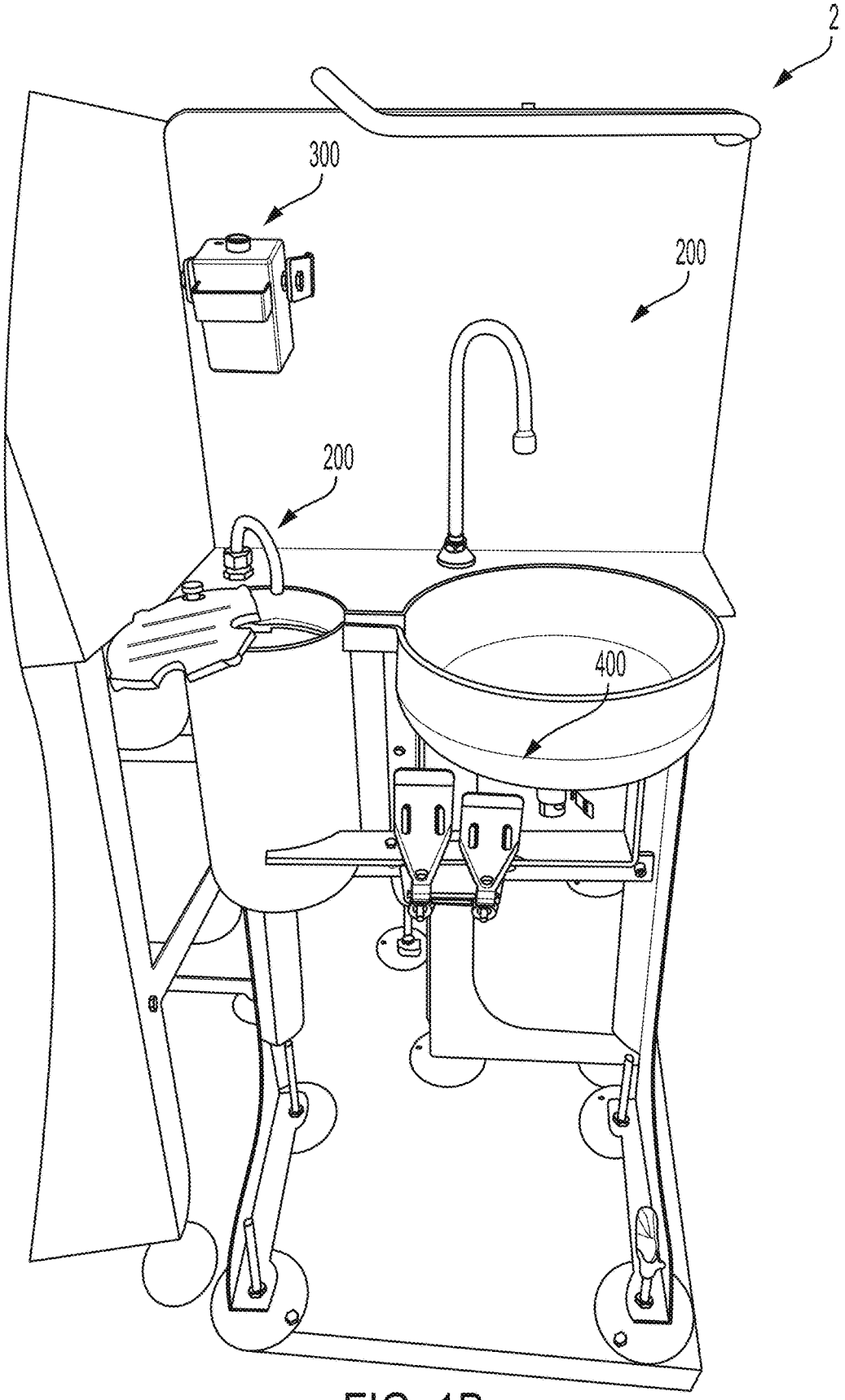

With reference to FIGS. 1A-B, a sanitation system 2 is provided. In various embodiments, the sanitation system 2 may be a system for cleaning tools. The sanitation system 2 may be a system for cleaning hands. The sanitation system 2 may be a system for cleaning both tools and hands.

The sanitation system 2 may have a work table 100. The work table 100 may provide a primary body to which other aspects of the system may be attached. The work table 100 may provide a surface for resting hands or tools. The work table 100 maybe a conventional table or another structure. In various embodiments, the work table 100 is formed of a unitary piece of material by bending or by welding, or another technology. The work table 100 may include a surface 104. The surface 104 may provide a horizontal member to support other aspects of the system 2 such as the sink 200 and/or tool cleaner 300. The work table 100 may have a splash wall 102. The splash wall 102 may be a vertically-extending member. The splash wall 102 may be connected to the surface 104. The splash wall 102 may be continuous with the surface 104. For instance, an uninterrupted union between the splash wall 102 and the surface 104 may be formed. The uninterrupted union may be a joint between the splash wall 102 and the surface 104. In various embodiments, the splash wall 102 and the surface 104 are formed from a single piece of material that is bent. The bend may be the uninterrupted union. In further instances, the splash wall 102 and the surface 104 are joined by welding or by another mechanism to create a single piece of material having an uninterrupted union from previously-multiple pieces of material. In this manner, the uninterrupted union ameliorates waste or bacteria accumulation by omitting any discontinuous or sharp edges or gaps such as may exist between separate pieces of material joined by fasteners.

The sanitation system 2 may have a sink 200. The sink 200 may be any basin with a fluid supply for washing. The sink 200 may be continuous with the surface 104 of the work table 100. For instance, the sink 200 may be joined to the surface 104 by welding. The sink 200 may be joined to the surface 104 in a manner to provide an uninterrupted union to ameliorate waste or bacteria accumulation by omitting any discontinuous or sharp edges or gaps such as may exist between separate pieces of material joined by fasteners. The sink 200 may be primarily for handwashing or for tool washing or may be for a combination of handwashing and tool washing.

The sanitation system 2 may have a tool cleaner 300. The tool cleaner 300 may be any basin with a fluid supply for cleaning tools. The tool cleaner 300 may be structured for a continuous flow of fluid to remove solids, protein, fat, oils, and other materials liberated from tools. For instance, the tool cleaner 300 may provide a tool cleaner reservoir to immerse tools and a continuous flow of fluid into the tool cleaner reservoir to overflow liberated materials from in and around the tools and out of the tool cleaner reservoir via a path adjacent an upper portion of the tool cleaner reservoir of the tool cleaner 300.

The sanitation system 2 may have a solution dispenser 400. For example, the sanitation system 2 may have a solution dispenser 400 that is elevated above the work table 100, sink 200, and/or tool cleaner 300 for dispensing of a cleaning solution to clean the work table 100, sink 200, tool cleaner 300, hands, tools, workpieces, and/or other articles.

Finally, the sanitation system 2 may have a control interface 500. The control interface 500 may include handles, levers, buttons, or other operating means, and valves. The control interface 500 may be operable to control the flow of fluid into the sink 200 and/or tool cleaner 300, or to control the flow of fluid out of the sink 200 and/or tool cleaner 300.

Figure 2:
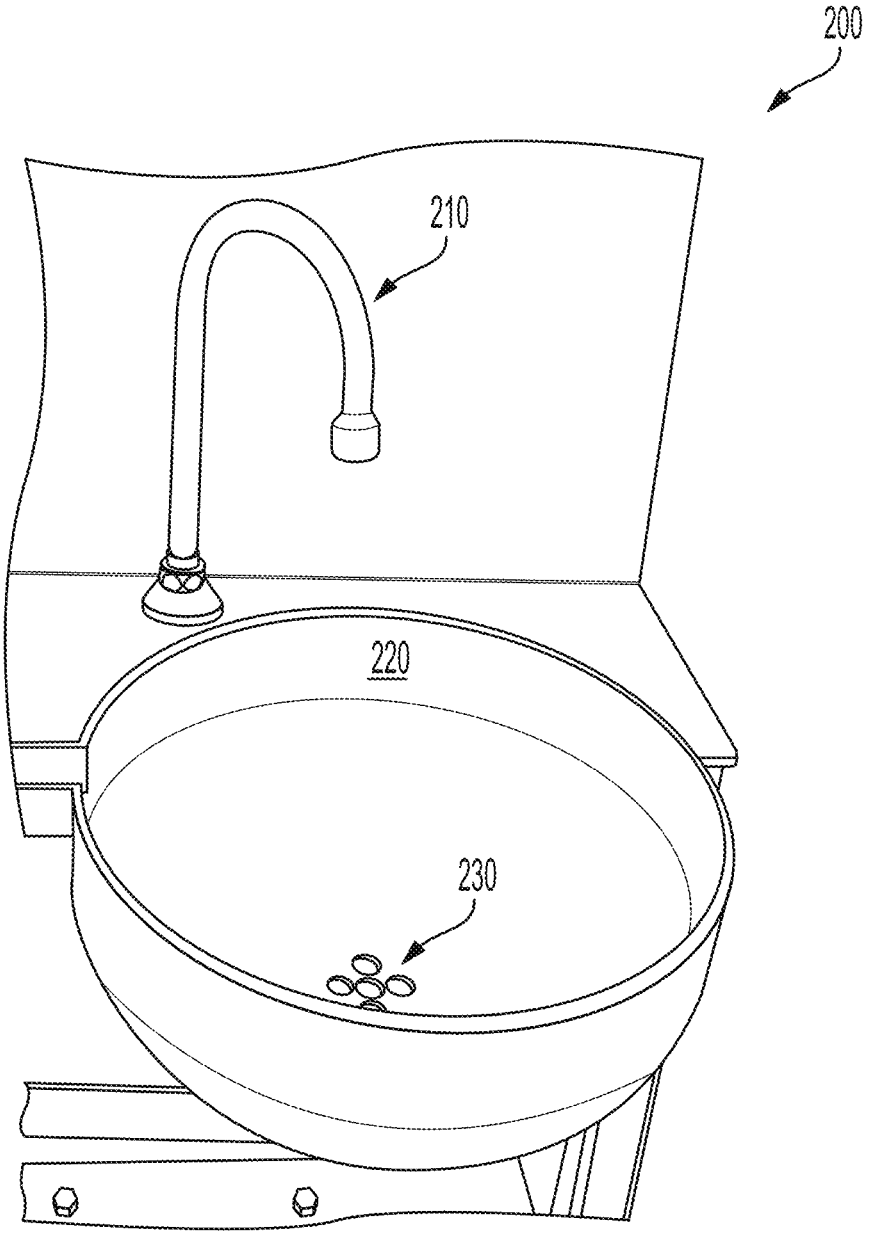
FIG. 2 illustrates a sink of the sanitation system, in accordance with various embodiments.

Having introduced features of the sanitation system 2 generally, now is a convenient time to detail specific aspects of each of the previously introduced features. With reference to FIG. 2, the sink 200 may have components. For instance, the sink 200 may include a spout 210. The spout 210 may comprise an aperture to fill a fluid into the sink 200. For instance, the spout 210 may be a curved member extending above the sink 200 to release fluid to fall over something being cleaned, such as hands, a workpiece, a tool, or the like, and into a bowl 220 of the sink 200. The sink 200 may include a bowl 220. The bowl 220 may comprise a fluid reservoir member such as a concave basin, or a basin of another shape that collects fluid from the spout 210 and/or detritus being washed from hands, a workpiece, a tool or the like. Moreover, the bowl 220 may also receive fluid and/or detritus from a tool cleaner 300, which may be connected to the bowl 220. The sink 200 may include a drain 230. The drain 230 may be an outlet disposed in the bowl 220, such as at the lowest point of the bowl 220, to receive the collected fluid and/or detritus and carry it away from the sink 200.

Figure 3A:
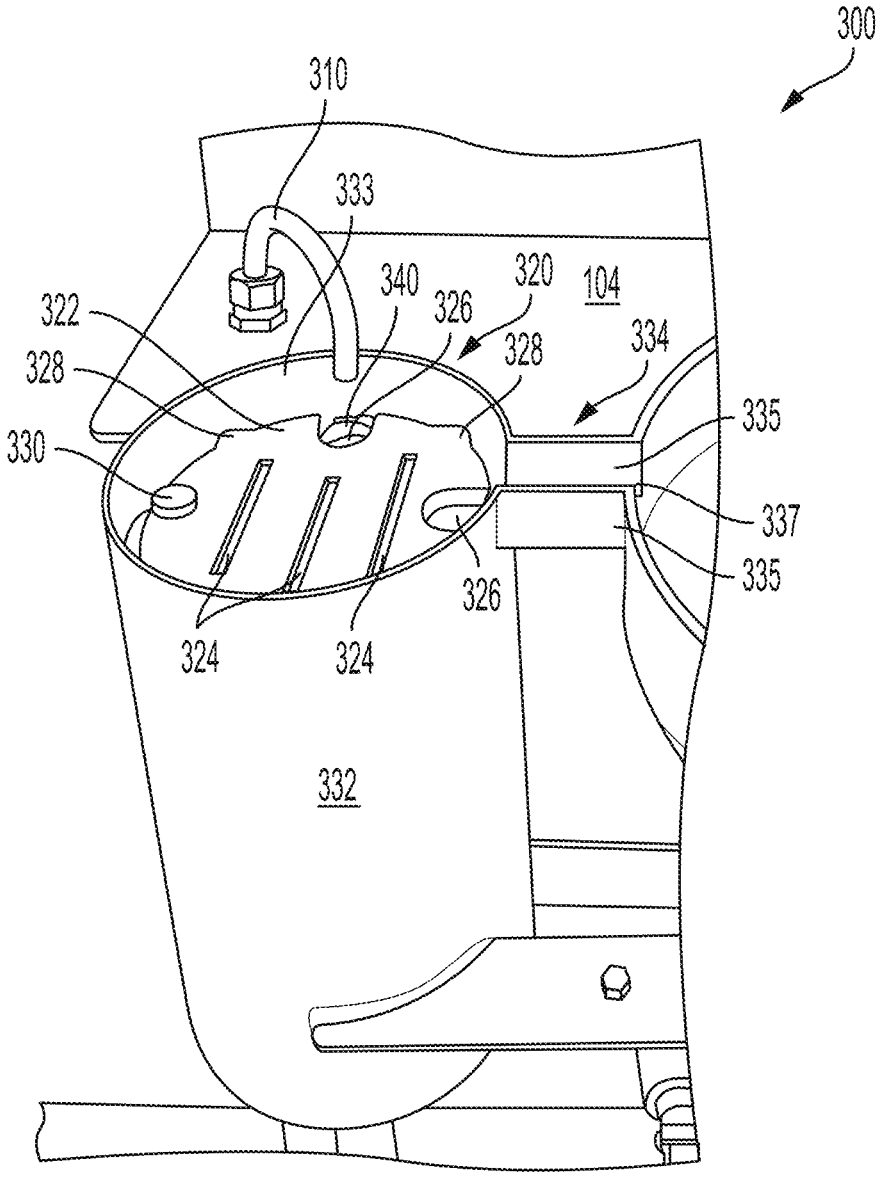
FIGS. 3A-3B illustrate views of a tool cleaner of the sanitation system, in accordance with various embodiments.
Figure 3B:
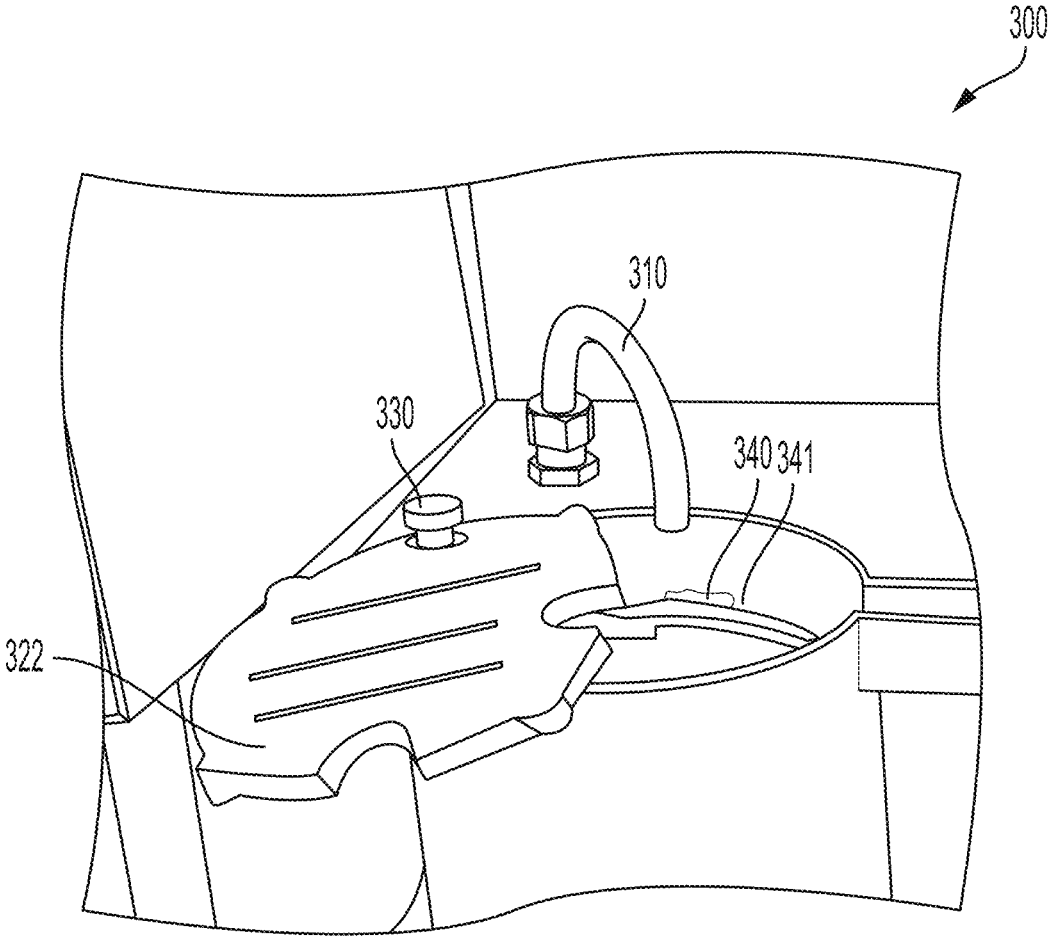

With reference to FIGS. 3A-3B, the tool cleaner 300 may have components. The tool cleaner 300 may have a tool holder 320. The tool holder 320 may be shaped to support a tool in the tool cleaner 300 for cleaning. For instance, the tool holder 320 may be a member that is removably insertable into the tool holder 320 to support tools.

The tool holder 320 may have a disk 322. The disk 322 may have slots 324. The slots 324 may extend through the disk 322 to allow a tool to be inserted through the disk 322 and be supported by the disk 322. For instance, a knife may be inserted through the slots 324 of the disk 322 with the blade extending into the tool holder 320 and into the tool cleaner 300, while the handle of the knife abuts against a surface of the disk 322 and is supported thereby. The disk 322 may have one or more cutout 326. A cutout 326 may be an aperture or a cut away portion of an edge of the disk 322. The cutouts 326 may be oriented to provide a path for fluid to flow into the tool cleaner 300 and/or out of the tool cleaner 300. For instance, a cutout 326 may be positioned to coincide with a spout 310 to permit fluid to flow into the tool cleaner 300 while ameliorating splashing of the fluid arising from hitting the disk 322. A cutout 326 may be positioned to coincide with a path of fluid flowing out of the tool cleaner 300 and into the sink 200. The disk 322 may have one or more orientation tabs 328. An orientation tab 328 maybe a local widening, thickening, or boss that extends away from the disk 322 to facilitate orientation and registration of the disk 322 in a desired position relative to other features of the tool cleaner 300.

The tool holder 320 may have an attachment device 330. The attachment device 330 may connect the disk 322 to the tool cleaner 300 so that the disk 322 does not become lost or separated from the tool holder 320. The attachment device 330 may include a rod extending through the disk 322 and into a feature of the tool cleaner 300. The rod may have a localized thickening to abut against the disk 322 so the disk 322 is not removable over the localized thickening or from the rod. The rod may be movable so that the disk 322 can be lifted away from the tool holder 320 but not readily separated therefrom. In this manner, cleaning of the tool cleaner 300 and the components of the tool cleaner 300 may be facilitated.

In addition to having a tool holder 320, the tool cleaner 300 may have a tool cleaner reservoir 332. A tool cleaner reservoir 332 may be a vessel to hold fluid so that tools inserted through the slots 324 of the disk 322 of the tool holder 320 are immersed in the fluid for cleaning. The tool cleaner reservoir 332 may have a wall 333 that is enclosed at one end by a floor 337. The wall 333 may be attached to the surface 104 of the work table 100 (FIGS. 1A-1B). For instance, the wall 333 may be welded to the surface 104 of the work table 100 (FIGS. 1A-1B) to provide a unitary surface without edges or discontinuities that would collect bacteria, detritus, or other unhygienic material.

With reference to FIG. 2 and FIGS. 3A-3B, the tool cleaner 300 may have an upper drain channel 334. The upper drain channel 334 is a fluid path between the tool cleaner 300 and the sink 200, and specifically between the tool cleaner reservoir 332 and the bowl 220. The upper drain channel 334 is positioned adjacent an upper edge of the tool cleaner reservoir 332 and may have sidewalls 335 with an upper edge coinciding with the surface 104 of the work table 100 (FIGS. 1A-1B). The upper drain channel 334 provides an outflow for fluid and detritus to flow away from the tool cleaner 300 to the drain 230 of the sink 200, while the tool cleaner reservoir 332 of the tool cleaner 300 remains full of fluid for immersion and cleaning of tools inserted into the tool holder 320. The upper drain channel 334 may have sidewalls 335 connected by a floor 337 to provide a channel to conduct fluid. The sidewalls 335 and the floor 337 may be integrally formed with or joined to the surface 104 of the work table 100 (FIGS. 1A-1B) and the bowl 220 of the sink 200 and the wall 333 of the tool cleaner reservoir 332 such as by welding or another mechanism to provide a unitary surface without edges or discontinuities that would collect bacteria, detritus, or other unhygienic material.

The tool cleaner 300 may have a tool holder support 340. The tool holder support 340 may be a resting surface to support the tool holder 320. For instance, the tool holder support 340 may be an annular boss extending inwardly from the wall 333 of the tool cleaner reservoir 332 to provide a localized resting face for the disk 322 of the tool holder 320 to contact and rest thereon. The annular boss may be attached to the wall 333 at periodic local attachment points, such as welds, and may be otherwise spaced from the wall 333 to form a gap 341 to facilitate cleaning. The tool holder support 340 may be continuous about an entire circumference of the wall 333 or may be discontinuous such as corresponding to spaced apart tabs or may have any structure to support the tool holder 320.

Figure 4A:
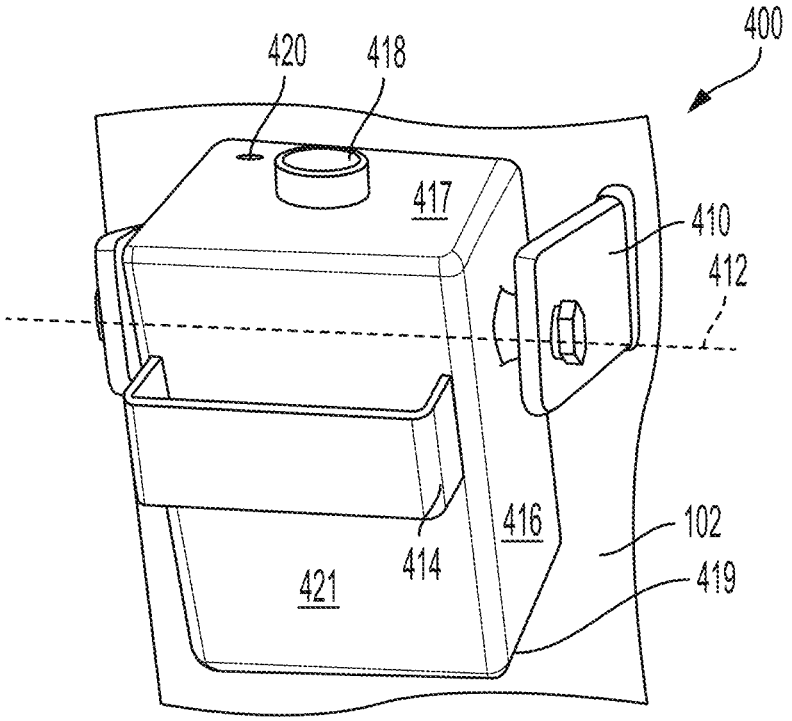
FIGS. 4A-4B illustrate views of a solution dispenser of the sanitation system, in accordance with various embodiments.
Figure 4B:
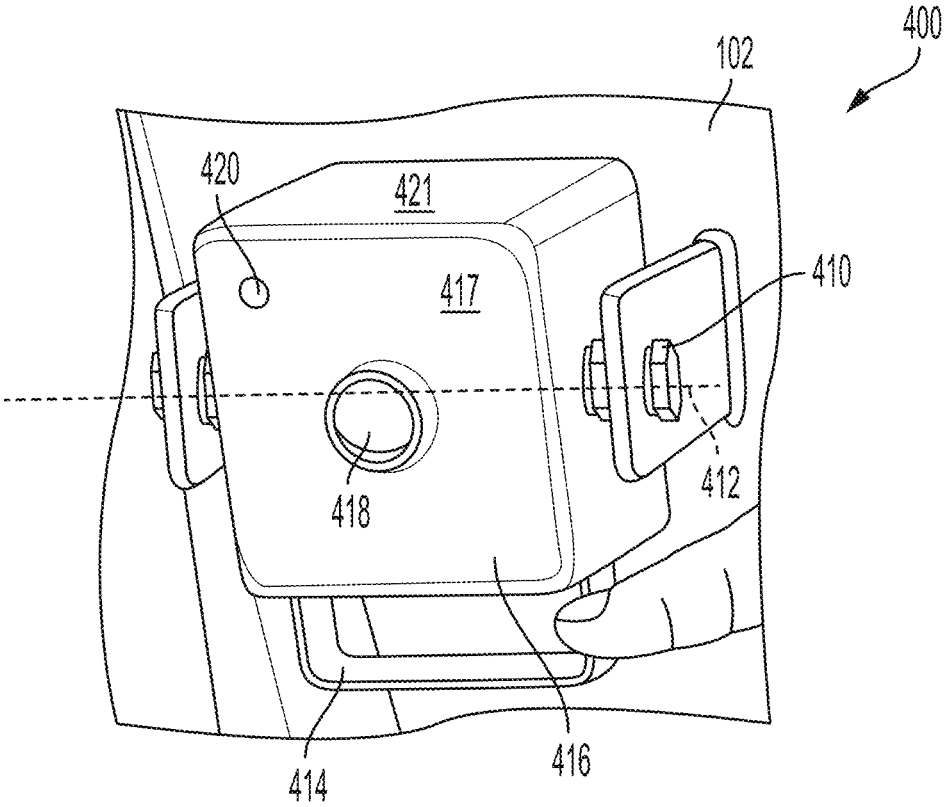
Figure 5:
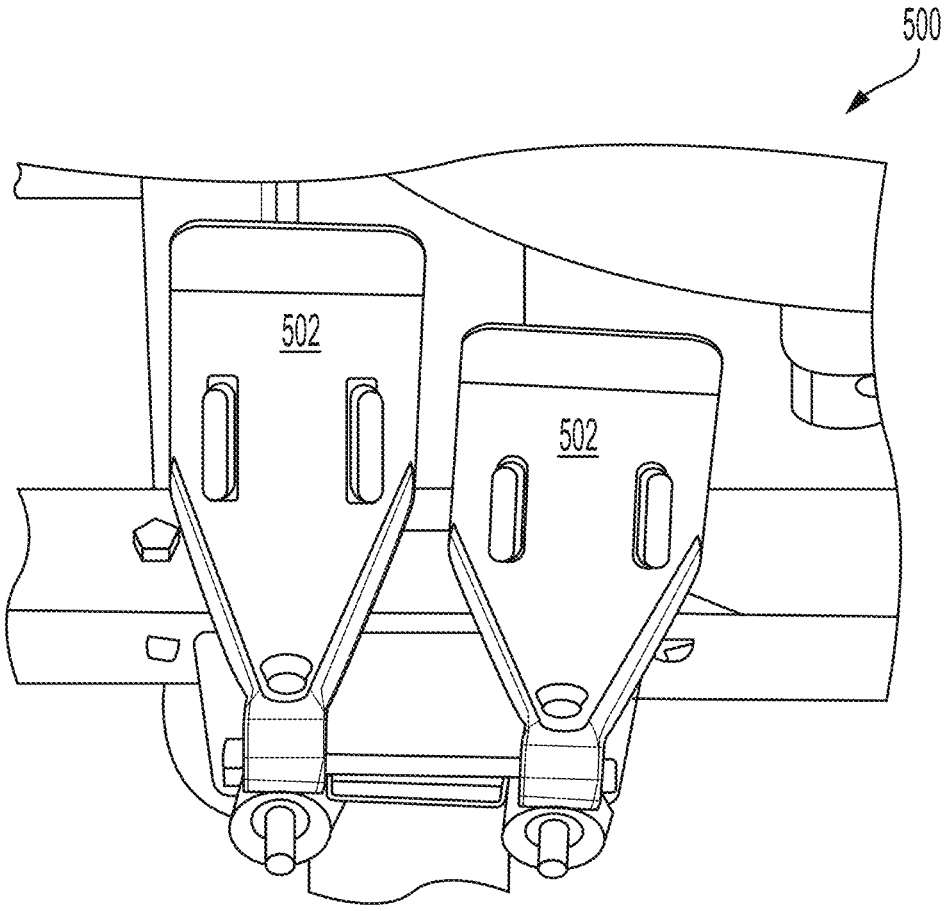
FIG. 5 illustrates a view of a control interface of the sanitation system, in accordance with various embodiments.

With reference to FIGS. 4A-4B, a solution dispenser 400 is provided in greater detail. The solution dispenser 400 may include a mount 410. For instance, the mount 410 may include bosses, arms, or other extensions cantilevering away from the splash wall 102 of the work table 100 (FIG. 1A-1B). The mount 410 may support a dispenser reservoir 416 to contain a cleaning solution such as soap. The mount 410 may support the dispenser reservoir 416 at a distance away from the splash wall 102 to facilitate movement of the dispenser reservoir 416 without contacting the splash wall 102. The mount 410 may be a rotational mount. For instance, a fastener or pair of fasteners may extend to connect the mount 410 to the dispenser reservoir 416 at a rotational axis 412. The dispenser reservoir 416 may rotate about the rotational axis 412 while remaining attached to the mount 410. The dispenser reservoir 416 may be a container having an upper side 417 and a lower side 419 connected by a dispenser reservoir wall 421 to define a container for a cleaning solution such as soap. A handle 414 may comprise a grabbable structure extending from the dispenser reservoir 416, such as a U-shaped bar extending from the dispenser reservoir wall 421 of the dispenser reservoir 416 to allow an operator to grab the handle 414 and manipulate the dispenser reservoir 416 for rotation about the rotational axis 412. A spout 418 may be defined through an upper side 417 of the dispenser reservoir 416 to facilitate pouring of content of the dispenser reservoir 416 in response to the rotation about the rotational axis 412. Moreover, a vent 420 may comprise an opening defined through the dispenser reservoir 416, such as through the upper side 417 of the dispenser reservoir 416 to facilitate venting of an interior space of the dispenser reservoir 416 as fluid flows from the spout 418 so that fluid more easily flows with a more consistent flow rate. With reference to FIGS. 1A-1B, the solution dispenser 400 may be oriented for pouring of solution into the sink 200, the tool cleaner 300, and/or onto the work table 100.

Finally, the sanitation system 2 may have a control interface 500. The control interface 500 includes human-operable interfaces that permit an operator to control valves. The control interface 500 may have paddles for knee operation or hip operation or foot operation or hand operation. The control interface 500 may operate to activate a flow of fluid through a spout 210 (FIG. 2) of a sink 200 (FIG. 2) or through a spout 310 (FIG. 3A-3B) of a tool cleaner 300 (FIG. 3A-3B) or a drain 230 (FIG. 2) of a sink 200 (FIG. 2) or a drain of a tool cleaner reservoir 332 (FIG. 3A-3B) of a tool cleaner 300 (FIG. 3A-3B).

Having discussed different features of the sanitation system 2 in detail, it is now useful to refer to the entire set of FIGS. 1A-5 for a discussion of some example implementations of a sanitation system 2 as described. For instance, a sanitation system 2 may include a sink 200. The sanitation system 2 may include a tool cleaner 300. The sink 200 may have a bowl 220. The tool cleaner 300 may have a tool cleaner reservoir 332 to hold water for cleaning of tools. The tool cleaner 300 may have an upper drain channel 334. The upper drain channel 334 may be a trough connected between tool cleaner reservoir 332 and the bowl 220 and configured to communicate water between the tool cleaner reservoir 332 and the bowl 220.

The sanitation system 2 may have other features. The upper drain channel 334 drains the water from the tool cleaner reservoir 332 to enable a continuous filling of the water into the tool cleaner reservoir 332 to wash tools therein. The sanitation system 2 may have a spout 310 to fill water into the tool cleaner reservoir 332 of the tool cleaner 300. The sink 200 may have a spout 210 for releasing fluid into the bowl 220 and a drain 230 for removing the fluid from the bowl 220. The system 2 may have a control interface 500. The control interface 500 may have a plurality of control paddles mounted below the sink 200 to operate one or more valve for the releasing the fluid into the bowl 220.

The trough of the upper drain channel 334 may have sidewalls 335 extending from the tool cleaner 300 to the bowl 220. Each sidewall may have an uppermost edge coplanar with a surface 104 of the work table 100. The trough of the upper drain channel 334 may also include a floor 337. The floor 337 may be coplanar with a tool holder 320 of the tool cleaner 300. The floor 337 may be lower than a tool holder 320 of the tool cleaner 300. The trough skims floating matter from fluid in the tool cleaner reservoir 332.

The tool cleaner 300 may have further features. For instance, the tool cleaner 300 may have a tool holder 320 with a selectively removable disk 322 inserted into the tool cleaner reservoir 332 and having slots 324 to receive tools through the disk 322 and into the tool cleaner reservoir 332. The tool holder 320 orients tools partially in the tool cleaner reservoir 332 for cleaning. The disk 322 may have two cutouts 326. The disk 322 may have a first cutout 326 to permit inflow of fluid past the disk 322 into the tool cleaner reservoir 332 and a second cutout 326 to permit outflow of fluid from the tool cleaner reservoir 332 into the upper drain channel 334. The disk 322 may have a plurality of orientation tabs 328 disposed at an edge of the disk 322 to orient the disk 322 within the tool cleaner reservoir 332 relative to edges of the tool cleaner reservoir 332. The tool cleaner 300 may also have concentric lip extending inwardly from a wall 333 of the tool cleaner reservoir 332 and providing a resting edge for the disk 322 to rest on.

In various embodiments, the tool holder 320 further includes an attachment device 330. The attachment device 330 may be a rod having a widened flange. The rod may pass through the disk 322. The widened flange may be connectable to the disk 322. The rod is slidable relative to the tool cleaner reservoir 332 to enable the disk 322 to be selectably lifted out of and inserted into the tool cleaner reservoir 332 for cleaning and use, respectively.

The system 2 may have a work table 100. The work table 100 may have a surface 104 continuous with an upper edge of the sink 200 and the tool cleaner 300. The work table 100 may also have a splash wall 102 extending perpendicularly from the surface 104 of the work table 100 in a single continuous piece of material continuous with the surface 104. The splash wall 102 supports a solution dispenser 400 at a distance from the surface 104.

The solution dispenser 400 may include a dispenser reservoir 416 attached to a mount 410. The mount 410 is attached to the splash wall 102. The dispenser reservoir 416 is rotationally attached to the mount 410 for rotation about a rotational axis 412. The mount 410 is biased off-center relative to the dispenser reservoir 416 so that the dispenser reservoir 416 is self-righting. The solution dispenser 400 has a spout 418 for pouring a solution from the dispenser in response to the rotation. The dispenser reservoir 416 is self-righting so that the dispenser resists pouring of the solution from the dispenser. The dispenser reservoir 416 may have a handle 414 extending from the dispenser reservoir 416 at a location between the rotational axis 412 coinciding to the rotational attachment device 330 of the dispenser reservoir 416 to the mount 410, and a lower side 419 of the dispenser reservoir 416 nearest the surface 104. The dispenser reservoir 416 may have a spout 418 extending from an upper side 417 of the dispenser reservoir 416 farthest from the surface 104. The rotational axis 412 is at a location between the location of the handle 414 and a location of the spout 418. The dispenser reservoir 416 may include a vent 420 defined through the upper side 417 of the dispenser reservoir 416 farthest from the surface 104.

In various examples, a further embodiment of the sanitation system 2 is provided. The system 2 may include a sink 200. The sink 200 may have a bowl 220. The system 2 may have a work table 100. The work table 100 may have a surface 104 continuous with an upper edge of the sink 200. The work table 100 may have a splash wall 102 extending perpendicularly from the surface 104 of the work table 100 in a single continuous piece of material continuous with the surface 104. The system 2 may include a solution dispenser 400. The solution dispenser 400 may be supported by the splash wall 102 at a distance from the surface 104. The solution dispenser 400 may have a dispenser reservoir 416 attached to a mount 410. The mount 410 is attached to the splash wall 102 and the dispenser reservoir 416 is rotationally attached to the mount 410 for rotation about a rotational axis 412. The mount 410 may be biased off-center relative to the dispenser reservoir 416 so that the dispenser reservoir 416 is self-righting. The solution dispenser 400 may have a spout 418 for pouring a solution from the dispenser in response to the rotation. The dispenser reservoir 416 is self-righting so that the dispenser resists pouring of the solution from the dispenser.

One or more further features are provided. For instance, the dispenser reservoir 416 may have a handle 414 extending from the dispenser reservoir 416 at a location between the rotational axis 412 coinciding to the rotational attachment device 330 of the dispenser reservoir 416 to the mount 410, and a lower side 419 of the dispenser reservoir 416 nearest the surface 104. The dispenser reservoir 416 may have a spout 418 extending from an upper side 417 of the dispenser reservoir 416 farthest from the surface 104. The rotational axis 412 is at a location between the location of the handle 414 and a location of the spout 418. The dispenser reservoir 416 may include a vent 420 defined through the upper side 417 of the dispenser reservoir 416 farthest from the surface 104.

The system 2 may have a tool cleaner 300. The tool cleaner 300 may include a tool cleaner reservoir 332 to hold water for cleaning of tools. The tool cleaner 300 may include an upper drain channel 334. The upper drain channel 334 may be a trough connected between tool cleaner reservoir 332 and the bowl 220 and configured to drain 230 water from the tool cleaner 300 into the bowl 220. The upper drain channel 334 may have sidewalls 335 and a floor 337. The sidewalls 335 may extend from the tool cleaner 300 to the bowl 220. Each sidewall may have an uppermost edge coplanar with a surface 104 of the work table 100. The floor 337 may extend between the sidewalls 335 and the tool cleaner 300 and the bowl 220. The upper drain channel 334 may form a trough that skims floating matter from fluid in the tool cleaner reservoir 332.

Yet further embodiments are contemplated. For instance, a sanitation system 2 may be provided. The system 2 may include a tool cleaner 300. The tool cleaner 300 may have a tool cleaner reservoir 332 to hold water for cleaning of tools. The tool cleaner 300 may have an upper drain channel 334 that is a trough connected between tool cleaner reservoir 332 and a drain 230 and that is configured to communicate water between the tool cleaner reservoir 332 and the drain 230. The tool cleaner 300 may have a tool holder 320. The tool holder 320 may be a selectively removable disk 322 inserted into the tool cleaner reservoir 332 and having slots 324 to receive tools through the disk 322 and into the tool cleaner reservoir 332. The tool holder 320 may orient tools partially in the tool cleaner reservoir 332 for cleaning. The system 2 may have a sink 200. The sink 200 may have a bowl 220 with the drain 230. The upper drain channel 334 may be connected to the bowl 220 to provide fluid passage from the trough to the drain 230. The system 2 may have a work table 100 having a surface 104. The surface 104 may be continuous with an upper edge of the bowl 220. The surface 104 may be continuous with an upper edge of the tool cleaner reservoir 332. The surface 104 may have a splash wall 102 extending perpendicularly from the surface 104 of the work table 100 in a single continuous piece of material continuous with the surface 104 to support a solution dispenser 400 at a distance from the surface 104.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments described herein are, for example, capable of operation in sequences other than those illustrated or otherwise described herein. Furthermore, the terms "include," and "have," and any variations thereof, are intended to cover a non-exclusive inclusion, such that a process, method, system, article, device, or apparatus that comprises a list of elements is not necessarily limited to those elements but may include other elements not expressly listed or inherent to such process, method, system, article, device, or apparatus.

The terms "left," "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments of the apparatus, methods, and/or articles of manufacture described herein are, for example, capable of operation in other orientations than those illustrated or otherwise described herein.

The terms "couple," "coupled," "couples," "coupling," and the like should be broadly understood and refer to connecting two or more elements mechanically and/or otherwise. Two or more electrical elements may be electrically coupled together, but not be mechanically or otherwise coupled together. Coupling may be for any length of time, e.g., permanent or semi-permanent or only for an instant. The absence of the word "removably," "removable," and the like near the word "coupled," and the like does not mean that the coupling, etc. in question is or is not removable.

As defined herein, two or more elements are "integral" if they are comprised of the same piece of material. As defined herein, two or more elements are "non-integral" if each is comprised of a different piece of material.

As defined herein, "approximately" can, in some embodiments, mean within plus or minus ten percent of the stated value. In other embodiments, "approximately" can mean within plus or minus five percent of the stated value. In further embodiments, "approximately" can mean within plus or minus three percent of the stated value. In yet other embodiments, "approximately" can mean within plus or minus one percent of the stated value.

Benefits, other advantages, and solutions to problems have been described herein with regard to specific embodiments. Furthermore, the connecting lines shown in the various figures contained herein are intended to represent exemplary functional relationships and/or physical couplings between the various elements. It should be noted that many alternative or additional functional relationships or physical connections may be present in a practical system. However, the benefits, advantages, solutions to problems, and any elements that may cause any benefit, advantage, or solution to occur or become more pronounced are not to be construed as critical, required, or essential features or elements of the disclosure. The scope of the disclosure is accordingly to be limited by nothing other than the appended claims, in which reference to an element in the singular is not intended to mean "one and only one" unless explicitly so stated, but rather "one or more." Moreover, where a phrase similar to "at least one of A, B, or C" is used in the claims, it is intended that the phrase be interpreted to mean that A alone may be present in an embodiment, B alone may be present in an embodiment, C alone may be present in an embodiment, or that any combination of the elements A, B and C may be present in a single embodiment; for example, A and B, A and C, B and C, or A and B and C. Different cross-hatching may be used throughout the figures to denote different parts but not necessarily to denote the same or different materials.

Methods, systems, and articles are provided herein. In the detailed description herein, references to "one embodiment," "an embodiment," "various embodiments," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described. After reading the description, it will be apparent to one skilled in the relevant art(s) how to implement the disclosure in alternative embodiments.

Furthermore, no element, component, or method step in the present disclosure is intended to be dedicated to the public regardless of whether the element, component, or method step is explicitly recited in the claims. No claim element herein is to be construed under the provisions of 35 U.S.C. 112(f) unless the element is expressly recited using the phrase "means for." As used herein, the terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus.

The invention claimed is:

1. A sanitation system comprising:

a sink comprising a bowl;

a tool cleaner comprising:

a tool cleaner reservoir to hold water for cleaning of tools; and an upper drain channel comprising a trough connected between the tool cleaner reservoir and the bowl and configured to communicate water between the tool cleaner reservoir and the bowl; and a spout to fill water into the tool cleaner reservoir, wherein the upper drain channel drains the water from the tool cleaner reservoir to enable a continuous filling of the water into the tool cleaner reservoir to wash tools therein, wherein the trough of the upper drain channel comprises sidewalls extending from the tool cleaner to the bowl, wherein each sidewall has an uppermost edge coplanar with a surface of a work table, and wherein the trough of the upper drain channel also comprises a floor coplanar with a tool holder of the tool cleaner, whereby the trough skims floating matter from fluid in the tool cleaner reservoir.

2. The sanitation system according to claim 1, wherein the tool holder comprises a selectively removable disk inserted into the tool cleaner reservoir and having slots to receive tools through the disk and into the tool cleaner reservoir, wherein the tool holder orients tools partially in the tool cleaner reservoir for cleaning.

3. The sanitation system according to claim 2, wherein the disk comprises two cutouts, a first cutout to permit inflow of fluid past the disk into the tool cleaner reservoir and a second cutout to permit outflow of fluid from the tool cleaner reservoir into the upper drain channel.

4. A sanitation system comprising:

a sink comprising a bowl;

a tool cleaner comprising:

a tool cleaner reservoir to hold water for cleaning of tools;

an upper drain channel comprising a trough connected between the tool cleaner reservoir and the bowl and configured to communicate water between the tool cleaner reservoir and the bowl;

a tool holder comprising a selectively removable disk inserted into the tool cleaner reservoir and having slots to receive tools through the disk and into the tool cleaner reservoir, wherein the tool holder orients tools partially in the tool cleaner reservoir for cleaning, wherein the disk comprises two cutouts, a first cutout to permit inflow of fluid past the disk into the tool cleaner reservoir and a second cutout to permit outflow of fluid from the tool cleaner reservoir into the upper drain channel; and a plurality of orientation tabs disposed at an edge of the disk to orient the disk within the tool cleaner reservoir relative to the tool cleaner reservoir.

5. The sanitation system according to claim 4, wherein the tool holder further comprises an attachment device comprising a rod having a widened flange, the rod passing through the disk, the widened flange connectable to the disk, and wherein the rod is slidable relative to the tool cleaner reservoir to enable the disk to be selectably lifted out of and inserted into the tool cleaner reservoir for cleaning and use, respectively.

6. A sanitation system comprising:

a sink comprising a bowl;

a tool cleaner comprising:

a tool cleaner reservoir to hold water for cleaning of tools; and an upper drain channel comprising a trough connected between the tool cleaner reservoir and the bowl and configured to communicate water between the tool cleaner reservoir and the bowl; and a work table, the work table comprising:

a surface continuous with an upper edge of the sink and the tool cleaner; and a splash wall extending perpendicularly from the surface of the work table in a single continuous piece of material continuous with the surface, wherein the splash wall supports a solution dispenser at a distance from the surface, wherein the solution dispenser comprises a dispenser reservoir attached to a mount, wherein the mount is attached to the splash wall and the dispenser reservoir is rotationally attached to the mount for rotation about a rotational axis, wherein the mount is biased off-center relative to the dispenser reservoir so that the dispenser reservoir is self-righting, wherein the solution dispenser comprises a spout for pouring a solution from the dispenser in response to the rotation, and wherein the dispenser reservoir is self-righting so that the dispenser resists pouring of the solution from the dispenser.

7. The sanitation system according to claim 6, wherein the dispenser reservoir comprises a handle extending from the dispenser reservoir at a location between (i) the rotational axis coinciding to the rotational attachment of the dispenser reservoir to the mount and (ii) a lower side of the dispenser reservoir nearest the surface.

8. The sanitation system according to claim 7, wherein the dispenser reservoir comprises a spout extending from an upper side of the dispenser reservoir farthest from the surface, and wherein the rotational axis is at a location between the location of the handle and a location of the spout.

9. The sanitation system according to claim 8, wherein the dispenser reservoir includes a vent defined through the upper side of the dispenser reservoir farthest from the surface.

10. A sanitation system comprising:

a sink comprising a bowl;

a tool cleaner comprising:

a tool cleaner reservoir to hold water for cleaning of tools; and an upper drain channel comprising a trough connected between the tool cleaner reservoir and the bowl and configured to communicate water between the tool cleaner reservoir and the bowl, wherein the sink comprises:

a spout for releasing fluid into the bowl; and a drain for removing the fluid from the bowl, wherein the system includes a control interface comprising a plurality of control paddles mounted below the sink to operate one or more valves for releasing the fluid into the bowl.

11. A sanitation system comprising:

a sink comprising a bowl;

a work table having (i) a surface continuous with an upper edge of the sink, and (ii) a splash wall extending perpendicularly from the surface of the work table in a single continuous piece of material continuous with the surface;

a solution dispenser supported by the splash wall at a distance from the surface, the solution dispenser comprising:

a dispenser reservoir attached to a mount, wherein the mount is attached to the splash wall, wherein the dispenser reservoir is rotationally attached to the mount for rotation about a rotational axis, wherein the mount is biased off-center relative to the dispenser reservoir so that the dispenser reservoir is self-righting; and a spout for pouring a solution from the dispenser in response to the rotation, wherein the dispenser reservoir is self-righting so that the dispenser resists pouring of the solution from the dispenser.

12. The sanitation system according to claim 11, wherein the dispenser reservoir comprises a handle extending from the dispenser reservoir at a location between (i) the rotational axis coinciding to the rotational attachment of the dispenser reservoir to the mount and (ii) a lower side of the dispenser reservoir nearest the surface.

13. The sanitation system according to claim 12, wherein the dispenser reservoir comprises a spout extending from an upper side of the dispenser reservoir farthest from the surface, and wherein the rotational axis is at a location between the location of the handle and a location of the spout.

14. The sanitation system according to claim 11, wherein the dispenser reservoir includes a vent defined through the upper side of the dispenser reservoir farthest from the surface.

15. The sanitation system according to claim 10, wherein the upper drain channel is further configured to drain water from the tool cleaner into the bowl.

16. The sanitation system according to claim 15, wherein the upper drain channel comprises:

sidewalls extending from the tool cleaner to the bowl, each sidewall having an uppermost edge coplanar with a surface of a work table; and a floor extending between the sidewalls and the tool cleaner and the bowl, whereby the upper drain channel forms a trough that skims floating matter from fluid in the tool cleaner reservoir.

* * * * *